US010102728B1

(12) United States Patent
Bajaj et al.

(10) Patent No.: US 10,102,728 B1
(45) Date of Patent: Oct. 16, 2018

(54) SMOKE DETECTOR FOR EVENT CLASSIFICATION AND METHODS OF MAKING AND USING SAME

(71) Applicant: Google LLC, Mountain View, CA (US)

(72) Inventors: Kunal Kishore Bajaj, Mountain View, CA (US); Andrii Korchak, Mountain View, CA (US)

(73) Assignee: Google LLC, Mountain View, CA (US)

( * ) Notice: Subject to any disclaimer, the term of this patent is extended or adjusted under 35 U.S.C. 154(b) by 0 days.

(21) Appl. No.: 15/623,092

(22) Filed: Jun. 14, 2017

(51) Int. Cl.
*G08B 17/10* (2006.01)
*G08B 21/14* (2006.01)

(52) U.S. Cl.
CPC ..... *G08B 17/10* (2013.01); *G08B 21/14* (2013.01)

(58) Field of Classification Search
CPC .... G08B 17/10; G08B 17/103; G08B 17/107; G08B 17/117; G08B 21/14; G08B 31/00
See application file for complete search history.

(56) References Cited

U.S. PATENT DOCUMENTS 6,507,023 B1 1/2003 Parham et al.
7,142,105 B2 * 11/2006 Chen ..... G08B 17/10 340/521
9,697,716 B2 * 7/2017 Duric ..... G08B 21/14
2012/0212346 A1 * 8/2012 Conforti ..... G08B 17/10 340/628
2013/0207807 A1 8/2013 Popper
2016/0019777 A1 * 1/2016 Peterson ..... G08B 17/10 340/506
2016/0073342 A1 * 3/2016 Szewczyk ..... H04W 52/0216 370/311
2016/0356752 A1 * 12/2016 Yocum ..... G01N 33/0004

OTHER PUBLICATIONS

Siemens; Aspirating Smoke Detection Very Sensitive and Reliable Fire Detection Through Differentiation Between Smoke and Deceptive Phenomena, White Paper, Jun. 9, 2015, www.siemens.com/asd; 9 pages.

* cited by examiner

*Primary Examiner* — Brian Zimmerman
*Assistant Examiner* — Sara Samson
(74) *Attorney, Agent, or Firm* — Kilpatrick Townsend & Stockton LLP

(57) ABSTRACT

A method of operating a smoke detector comprising an illuminator, a light sensor, and a carbon monoxide sensor includes the step of measuring a voltage signal in response to an electromagnetic signal emitted by the illuminator. The method comprises the step of determining a smoke concentration using the voltage signal, and the step of determining a carbon monoxide concentration using the carbon monoxide sensor. The method includes comparing the smoke concentration and the carbon monoxide concentration to a warning zone criteria, and the step of calculating a rate of increase of at least one of smoke and carbon dioxide based on a determination that the warning zone criteria is unmet. The method comprises generating an alarm in response to a determination of a warning condition.

20 Claims, 14 Drawing Sheets

SMOKE DETECTOR FOR EVENT CLASSIFICATION AND METHODS OF MAKING AND USING SAME

BACKGROUND

Photoelectric smoke detectors in residential and commercial buildings include a smoke chamber, a light source, a carbon monoxide sensor, and a photodetector. When smoke from an object enters the smoke chamber, it affects the photodetector output, which is used to determine a concentration of smoke in the chamber. The smoke concentration is evaluated together with the carbon monoxide concentration to determine if the smoke is associated with an emergency event or a non-emergency event. If the event is an emergency event, the smoke detector generates a warning alarm. Evaluation of the smoke concentration together with the carbon monoxide concentration does not allow for an emergency event to be distinguished from a non-emergency event in all cases.

SUMMARY OF THE EMBODIMENTS

In an embodiment, a method of operating a smoke detector having an illuminator and a light sensor includes the step of measuring a voltage signal in response to an electromagnetic signal emitted by the illuminator. The method includes determining a smoke concentration using the voltage signal, and calculating a rate of increase of smoke. The method comprises using the rate of increase of smoke to determine an adjusted smoke concentration, and the step of comparing the adjusted smoke concentration to a threshold. The method includes generating a warning alarm in response to a finding that the adjusted smoke concentration exceeds the threshold.

In another embodiment, a smoke detector comprises an illuminator configured to emit an electromagnetic signal, and a light sensor configured to generate a voltage signal in response to the electromagnetic signal. The smoke detector has a carbon monoxide sensor, and a memory storing computer-readable instructions. The smoke detector includes a processor configured to execute the instructions to: (a) determine a smoke concentration; (b) calculate a rate of increase of smoke based upon a determination that the smoke concentration is in an ambiguous zone; (c) determine an adjusted smoke concentration using the smoke concentration and the rate of increase of smoke; and (d) generate an alarm based on a comparison of the adjusted smoke concentration to a threshold.

In yet another embodiment, a method of operating a smoke detector comprising an illuminator, a light sensor, and a carbon monoxide sensor includes the step of measuring a voltage signal in response to an electromagnetic signal emitted by the illuminator. The method comprises the step of determining a smoke concentration using the voltage signal, and the step of determining a carbon monoxide concentration using the carbon monoxide sensor. The method includes comparing the smoke concentration and the carbon monoxide concentration to a warning zone criteria, and the step of calculating a rate of increase of at least one of smoke and carbon dioxide based on a determination that the warning zone criteria is unmet. The method comprises generating an alarm in response to a determination of a warning condition.

DETAILED DESCRIPTION OF THE EMBODIMENTS

Figure 1:
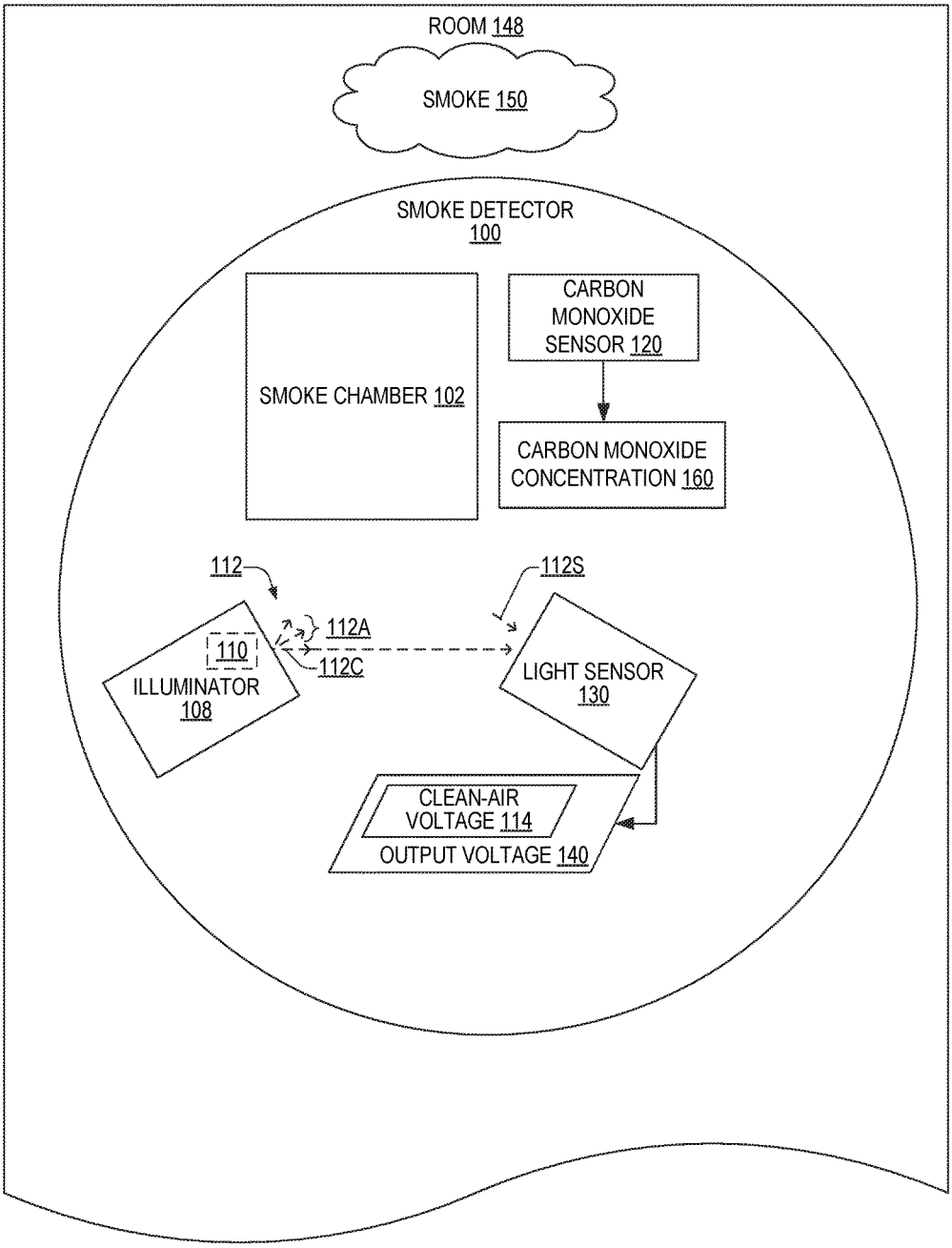
FIG. 1 is a schematic diagram of a smoke detector, in an embodiment.

FIG. 1 is a schematic diagram of an example photoelectric light scattering smoke detector 100 in a room 148 that includes smoke 150. Smoke detector 100 includes a smoke chamber 102, an illuminator 108, a carbon monoxide sensor 120, and a light sensor 130. Illuminator 108 may include one or more light sources 110, which may be a light-emitting diode (LED), laser diode, or other light source known in the art. Light sensor 130 may include one or more photodetectors.

Illuminator 108 emits light 112, which includes light portions 112A and 112C. Light portion 112A propagates towards the smoke chamber 102 and light portion 112C propagates towards the light sensor 130. Light sensor 130 produces an output voltage 140 in response to detecting light portion 112C. In a "clean-air" condition, when smoke chamber 102 contains no smoke, light sensor 130 detects only light portion 112C and produces a corresponding clean-air current and associated clean-air voltage 114. While in that state, the output voltage 140 (which is thus at a clean air voltage level) can be thought of as being in a clean air condition. However, when smoke 150 is in smoke chamber 102, smoke 150 scatters part of light portion 112A as scattered light 112S toward light sensor 130, which increases output voltage 140. In the clean-air state, when smoke chamber 102 contains no smoke, light portion 112A does not reach light sensor 130.

It is envisioned that the spatial arrangement of smoke chamber 102, illuminator 108, and light sensor 130 may differ from the arrangement illustrated in FIG. 1. Without departing from the scope hereof, smoke detector 100 may be a photoelectric light obscuration smoke detector, such that output voltage 140 falls below clean-air voltage 114 when smoke 150 is in smoke chamber 102.

Figure 2:
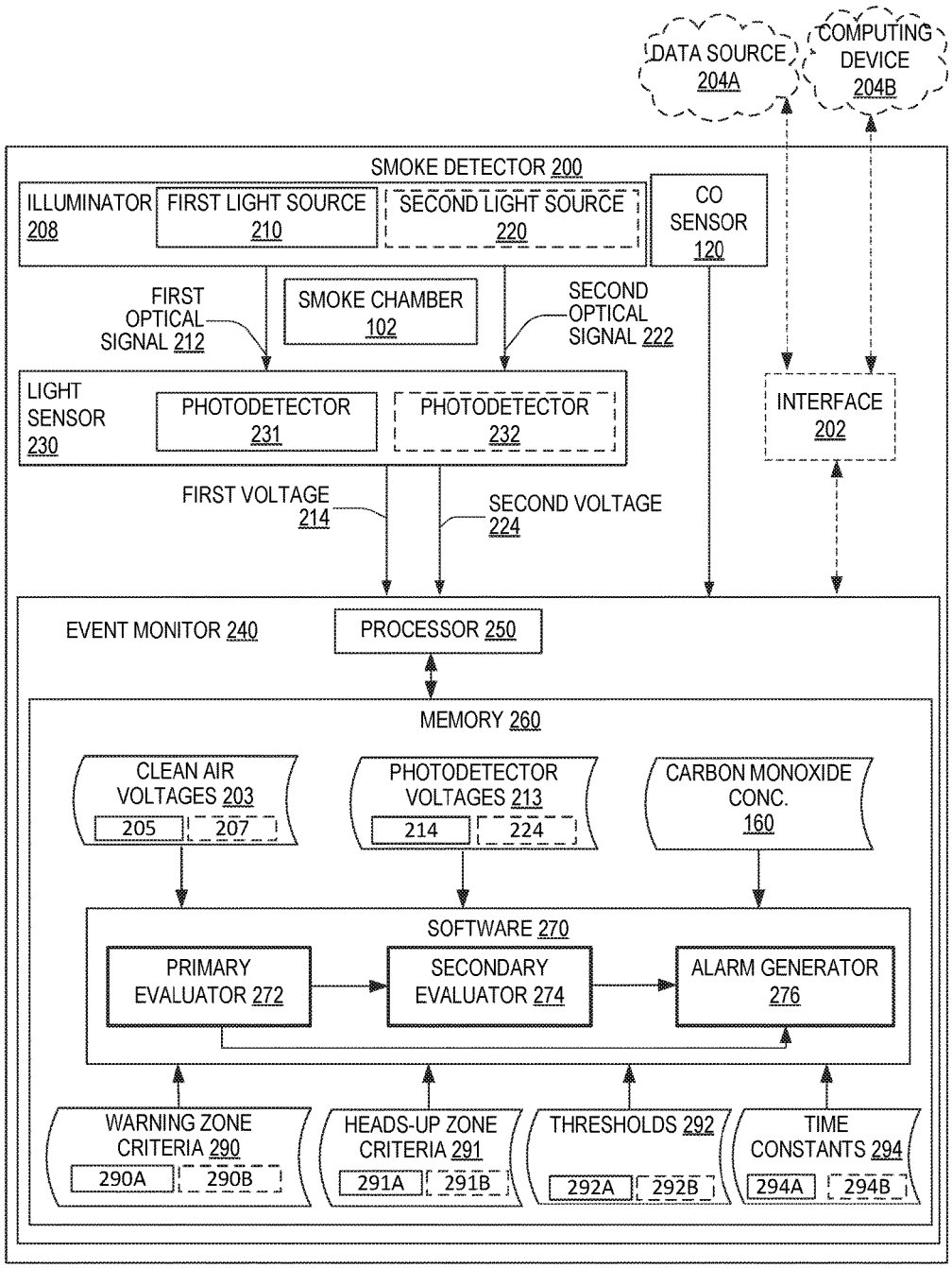
FIG. 2 is a schematic diagram of a smoke detector, which is a more detailed example of the smoke detector of FIG. 1.

FIG. 2 is a schematic diagram of a smoke detector 200, which is an example of smoke detector 100. Smoke detector 200 may effectuate smoke detection via at least one of photoelectric light scattering and photoelectric light obscuration. Smoke detector 200 includes illuminator 208, smoke chamber 102, a light sensor 230, carbon monoxide sensor 120, and an event monitor 240.

Illuminator 208 is an example of illuminator 108 and includes a first light source 210. Light sensor 230 is an example of light sensor 130 and includes a first photodetector 231. Illuminator 208 may include a second light source 220 and light sensor 230 may include a second photodetector 232. Light sources 210 and 220 are each an example of light source 110. In some embodiments, the number of light source(s) and photodetector(s) in the illuminator 208 and light sensor 230, respectively, may be different (e.g., the illuminator 208 may have two light sources and the light sensor 230 may have a solitary photodetector).

The size of particles constituting smoke 150 depends on its source, e.g., on the type of process that produces smoke 150. Illuminator 208 may be configured to emit more than one wavelength of light into smoke chamber 102, which enables detection of, and differentiation of, types of smoke that differ in particle size. In an example mode of operation, first light source 210 emits a first optical signal 212 having a first center wavelength $\lambda_1$. Illuminator 208, e.g., via second light source 220, emits a second optical signal 222 having a second center wavelength $\lambda_2$.

In embodiments, first center wavelength $\lambda_1$ exceeds the second center wavelength $\lambda_2$. For example, light source 210 emits near-infrared (near-IR) light and light source 220 emits blue light such that $\lambda_1$ is between 0.66 μm and 1.0 μm and $\lambda_2$ is between 0.40 μm and 0.48 μm. At least one of first center wavelength $\lambda_1$ and second center wavelength $\lambda_2$ may be outside the optical portion of the electromagnetic spectrum without departing from the scope hereof. For example, second center wavelength $\lambda_2$ may be shorter than 0.40 μm and first center wavelength $\lambda_1$ may exceed 1.0 μm.

In embodiments where the smoke detector 200 includes, in addition to the first light source 210 and the first photodetector 231, the second light source 220 and the second photodetector 232, the first photodetector 231 is configured to detect first center wavelength $\lambda_1$ and the second photodetector 232 is configured to detect second center wavelength $\lambda_2$. For example, first photodetector 231 includes a bandpass filter that transmits first center wavelength $\lambda_1$ and blocks second center wavelength $\lambda_2$, while second photodetector 232 includes a bandpass filter that transmits second center wavelength $\lambda_2$ and blocks first center wavelength $\lambda_1$. Photodetectors 231 and 232 may have spectral response curves optimized for first center wavelength $\lambda_1$ and second center wavelength $\lambda_2$, respectively.

Light sensor 230, specifically the first photodetector 231 thereof, is configured to produce first photodetector voltage 214 in response to the first optical signal 212. The amplitude of the first photodetector voltage 214 is proportional to, or otherwise corresponds to, the first optical signal 212. The second photodetector 232 of the light sensor 230 is configured to produce second photodetector voltage 224 in response to second optical signal 222. The amplitude of the second photodetector voltage 224 is proportional to, or otherwise corresponds to, the second optical signal 222. The first photodetector voltage 214 and the second photodetector voltage 224 may be sampled periodically by the event monitor 240 to ascertain a concentration of smoke in the chamber 102.

Event monitor 240 is a type of computer. In embodiments, event monitor 240 includes a processor 250 and a memory 260, which are communicatively coupled. Memory 260 may be transitory and/or non-transitory and may represent one or both of volatile memory (e.g., SRAM, DRAM, computational RAM, other volatile memory, or any combination thereof) and non-volatile memory (e.g., FLASH, ROM, magnetic media, optical media, other non-volatile memory, or any combination thereof). The processor 250 represents one or more digital processors. The processor 250 may be a microprocessor, and in embodiments, part or all of memory 260 may be integrated into processor 250. In some embodiments, the processor 250 may be configured through particularly configured hardware, such as an application specific integrated circuit (ASIC), field-programmable gate array (FPGA), etc., and/or through execution of software to perform functions in accordance with the disclosure herein.

The event monitor 240, in the memory 260, may store clean air voltage(s) 203, photodetector voltage(s) 213, carbon monoxide concentration 160, warning zone criteria 290, heads-up zone criteria 291, threshold(s) 292, and time constant(s) 294. The clean air voltage(s) 203 may include a first clean air voltage 205 and a second clean air voltage 207, the photodetector voltage(s) 213 may include the first voltage 214 and the second voltage 224, the warning zone criteria 290 may include a first warning zone criteria 290A and a second warning zone criteria 290B, the heads-up zone criteria 291 may include a first heads-up zone criteria 291A and a second heads-up zone criteria 291B, the threshold(s) 292 may include a first threshold 292A and a second threshold 292B, and the time constant(s) 294 may include a first time constant 294A and a second time constant 294B. The first clean air voltage 205, first photodetector voltage 214, first warning zone criteria 290A, first heads-up zone criteria 291A, first threshold 292A, and first time constant 294A may each be associated with the first light source 210 (e.g., with the near-infrared source). The second clean air voltage 207, second photodetector voltage 224, second warning zone criteria 290B, second heads-up zone criteria 291B, second threshold 292B, and second time constant 294B may each be associated with the second light source 220 (e.g., with the blue light source). The discussion below details the operation of the event monitor 240 with respect to the first voltage 214 associated with the first light source 210. The artisan, however, will understand that the operation of the event monitor 240 with respect to the second voltage 224 associated with the second light source 220 may be generally identical, and that the first voltage 214 and the second voltage 224 may, in embodiments, be evaluated by the event monitor 240 in parallel.

In embodiments, smoke detector 200 may include a network interface 202 that communicatively couples the event monitor 240 to remote data source 204A and, in some embodiments, a computing device 204B. Remote data source 204A is a server, for example. Remote data source 204A may provide event monitor 240 with updated versions of at least one of the clean air voltages 203, warning zone criteria 290, heads-up zone criteria 291, thresholds 292, and time constants 294. Interface 202 is, for example, a network interface such that remote data source 204A and event monitor 240 communicate via a wired communication channel, a wireless communication channel, or a combination thereof. In an embodiment, remote data source 204A includes at least part of the event monitor 240, such that at least part of event monitor 240 is remotely located from illuminator 208 and light sensor 230.

As discussed herein, the event monitor 240 may, in embodiments, distinguish between a normal condition (or event), a heads-up condition, and a warning condition. Under normal conditions, there may be no smoke 150 in the chamber 102 and the first voltage 214 may be generally equal to the first clean air voltage 205. In each of a heads-up event and a warning event, smoke 150 in the chamber 102 may cause the first voltage 214 to exceed the first clean air voltage 205. In embodiments, the event monitor 240 may cause a heads-up alert to be generated in response to an identification of a heads-up event. The event monitor 240 may further cause a warning (or emergency) alarm to be generated in response to an identification of a warning event. The heads-up alert, where generated in response to a heads-up event, may indicate that the smoke concentration and/or carbon monoxide concentration 160 is non-zero, but is currently below emergency levels. The warning alarm generated in response to a warning event may indicate that the smoke concentration and/or carbon monoxide concentration has reached emergency levels. The heads-up alert may, for example, be a precursor to the warning alarm and/or indicate a nuisance condition. As one example, where smoke from a broiling burger enters the chamber 102, the event monitor 240 may categorize such as a heads-up event. Alternately, where smoke from a flaming couch (or another burning object) enters the chamber 102, the monitor 240 may categorize the event as a warning event. In some embodiments, the event monitor 240 may initially categorize an event as a heads-up event, and as the smoke concentration and/or carbon monoxide within the smoke chamber 102 continues to increase, categorize the event as a warning event.

The heads-up alert generated in response to a heads-up event may be milder than a warning alarm generated in response to a warning event. For example, in an embodiment, the heads-up alert may comprise a gentle beep accompanied by a yellow light, and the emergency alarm may comprise a loud siren accompanied by a red light. In some embodiments, the event monitor 240 may identify a warning event, but the identification of the heads-up event may be omitted; in these embodiments, a cautionary notification may be generated by the event monitor 240 only upon the identification of a warning event.

In some embodiments, the event monitor 240 (e.g., an alarm generator 276 thereof as discussed below) may communicate the heads-up alert or the warning alarm (e.g., wirelessly, via the interface 202) to the computing device 204B of a user or administrator (e.g., a smart phone of the owner of the structure where the smoke detector 200 is located and/or to the computing device of a third party administrator). The user may be allowed to silence or interrupt the heads-up alert via the computing device 204B (e.g., the smoke detector 100 may have associated therewith a mobile application installed on the computing device 204B, and the user may depress a button on an interface of the application to silence or interrupt the heads-up alert). A warning alarm, on the other hand, may not be so readily silenced and may require additional steps to be turned off.

The smoke detector 200 may be communicatively coupled via the interface 202 to another smoke detector or smoke detectors (e.g., the smoke detector 200 in room 148 of a house may be in data communication with the smoke detector in another room of that house); in these embodiments, when the event monitor 240 of one smoke detector 200 generates a heads-up alert or a warning alarm, the event monitors 240 of other smoke detectors in communication therewith may automatically generate a heads-up alert or warning alarm.

The event monitor 240 may identify an event as one of a normal event, a heads-up event, and a warning event using the software 270. The software 270 may be stored in a transitory or non-transitory portion of the memory 260. In an embodiment, the software 270 includes a primary evaluator 272, a companion (or secondary) evaluator 274, and an alarm generator 276. Each of the primary evaluator 272, secondary evaluator 274, and alarm generator 276 may include or have associated therewith machine readable instructions to allow the event monitor 240 to function as described herein.

The primary evaluator 272 may utilize the first photodetector voltage 214, the first clean air voltage 205, and the carbon monoxide concentration 160 to determine if the event is one of a normal event, a heads-up event, and a warning event. Where the primary evaluator 272 is unable to identify the event as one of a normal event, a heads-up event, and a warning event, the event may be categorized as an ambiguous event. When an event is categorized by the primary evaluator 272 as an ambiguous event, the event monitor 240 may call the secondary evaluator 274 to evaluate the ambiguous event and resolve the ambiguity. The secondary evaluator 274 may determine whether the ambiguous event is a heads-up event or a warning event. In an embodiment, the secondary evaluator 274 may determine and evaluate the rate of increase of smoke in the chamber 102 to identify the event as one of a heads-up event and a warning event.

Figure 3:
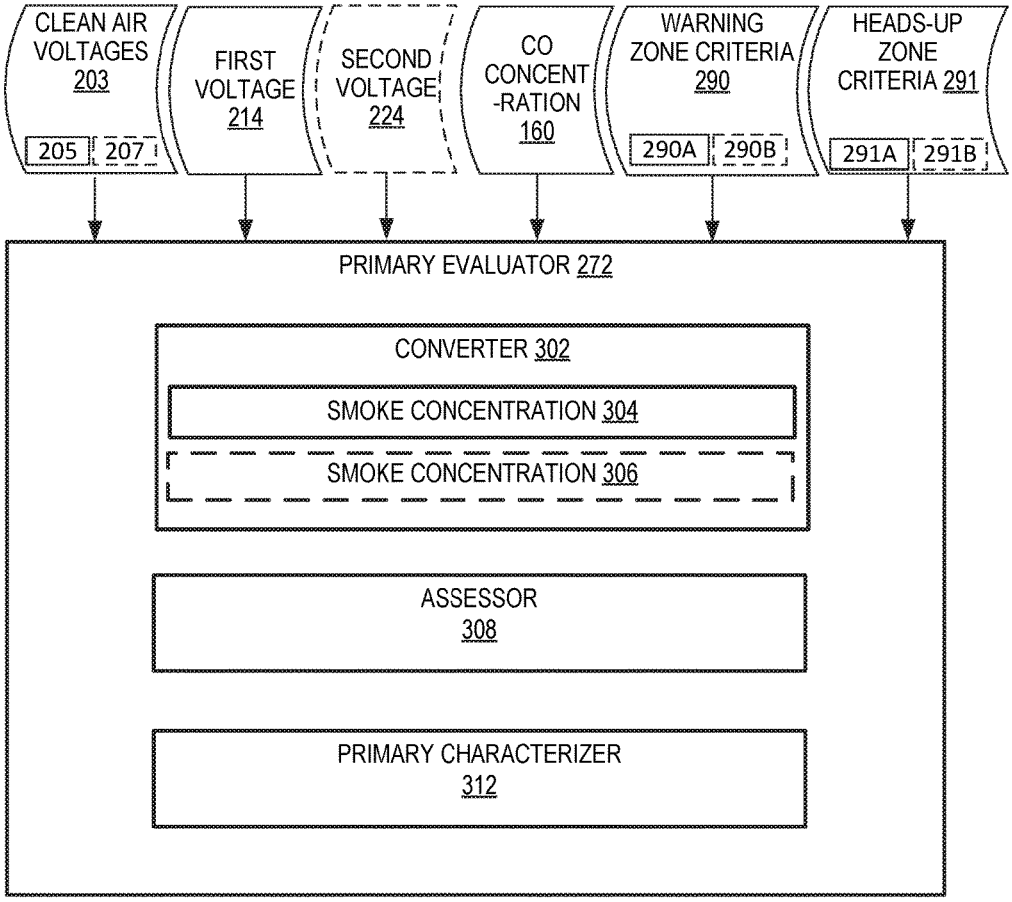
FIG. 3 is a schematic diagram illustrating a primary evaluator of the smoke detector of FIG. 2.

FIG. 3 shows the primary evaluator 272 in more detail. The primary evaluator 272 may include a converter 302, an assessor 308, and a primary characterizer 312. The assessor 308 may initially compare the first voltage 214 to the first clean air voltage 205. Where the first voltage 214 is generally equal to the first clean air voltage 205, the primary evaluator 272 may determine that the smoke chamber 102 does not contain an appreciable quantity of smoke. The primary characterizer 312 may therefore identify the event as a normal event (i.e., the primary evaluator 272 may determine that the smoke detector 200 is operating under normal (e.g., clean air) conditions). Alternately, if the first voltage 214 is greater than the first clean air voltage 205, the primary evaluator 272 may evaluate the first voltage 214 to determine if the event is a heads-up event or a warning event.

The value of the first voltage 214 may relate (e.g., be proportional or otherwise correspond) to the concentration of the smoke 150 in the chamber 102. As is known, the converter 302 may convert the first voltage 214 (V) to smoke concentration 304 (dB/m), e.g., by multiplying the first voltage 214 with a predefined gain. The assessor 308 may then compare the smoke concentration 304, and in embodiments, each of the smoke concentration 304 and the carbon monoxide concentration 160, with the first warning zone criteria 290A to determine if the event is a warning event. If the first warning zone criteria 290A is met, the primary characterizer 312 may categorize the event as a warning event.

Figure 4A:
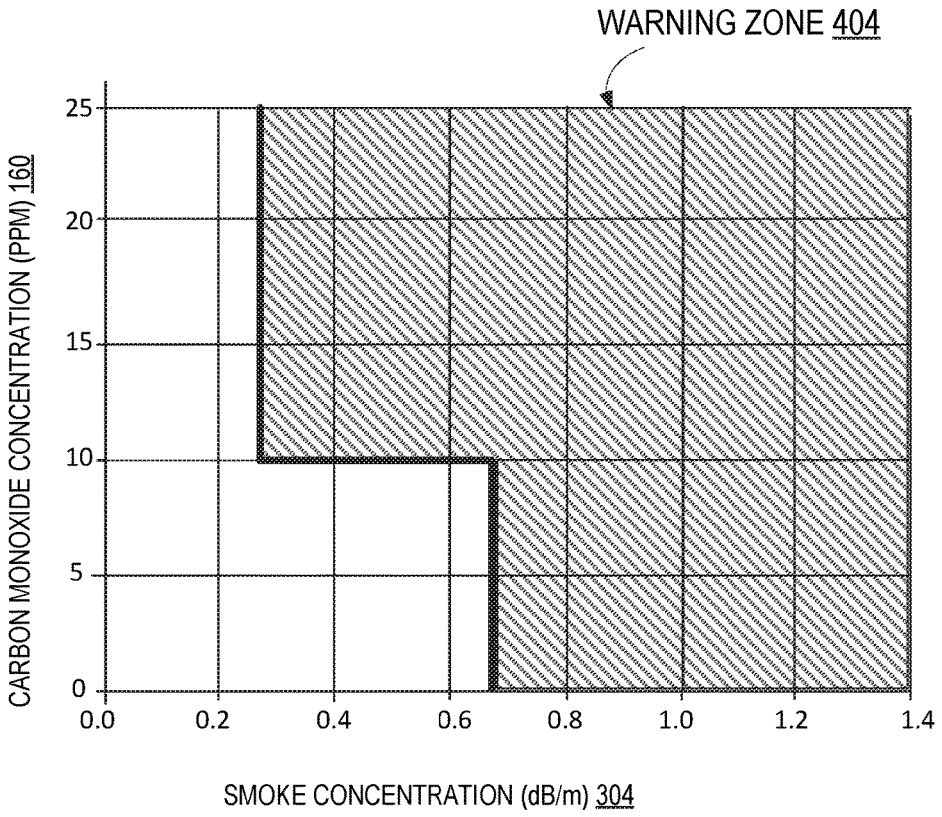
FIG. 4A is a schematic diagram illustrating a warning zone associated with the smoke detector of FIG. 2.
Figure 5:
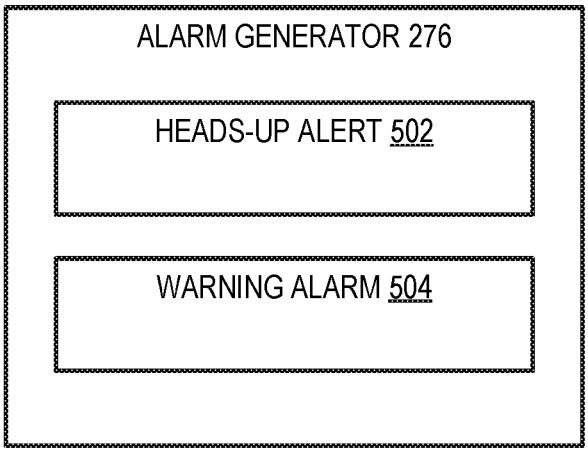
FIG. 5 is a schematic diagram illustrating an alarm generator of the smoke detector of FIG. 2.

FIG. 4A schematically illustrates the warning zone 404, in an embodiment. An event may be categorized by the primary characterizer 312 as a warning event if the assessor 308 determines that the event falls in the warning zone 404 (i.e., meets the warning zone criteria 290A). In the illustrated embodiment, the warning zone criteria 290A may include the following: (a) smoke concentration 304 is greater than or equal to 0.66 dB/m; or (b) smoke concentration 304 is greater than or equal to 0.28 dB/m, and the carbon monoxide concentration 160, as determined by the carbon monoxide sensor 120, is greater than 10 parts per million. If the assessor 308 determines that either of warning zone criteria (a) or (b) is met, the primary characterizer 312 may categorize the event as a warning event. The alarm generator 276 (FIGS. 2 and 5) may generate a warning alarm 504 in response to apprise the user of a warning condition. For example, the alarm generator 276 may generate a warning alarm 504 where the smoke concentration 304 is 1.2 dB/m. Similarly, for example, the alarm generator 276 may generate a warning alarm 504 where the smoke concentration 304 is 0.5 dB/m and the carbon monoxide concentration 160 is 13 parts per million.

Figure 4B:
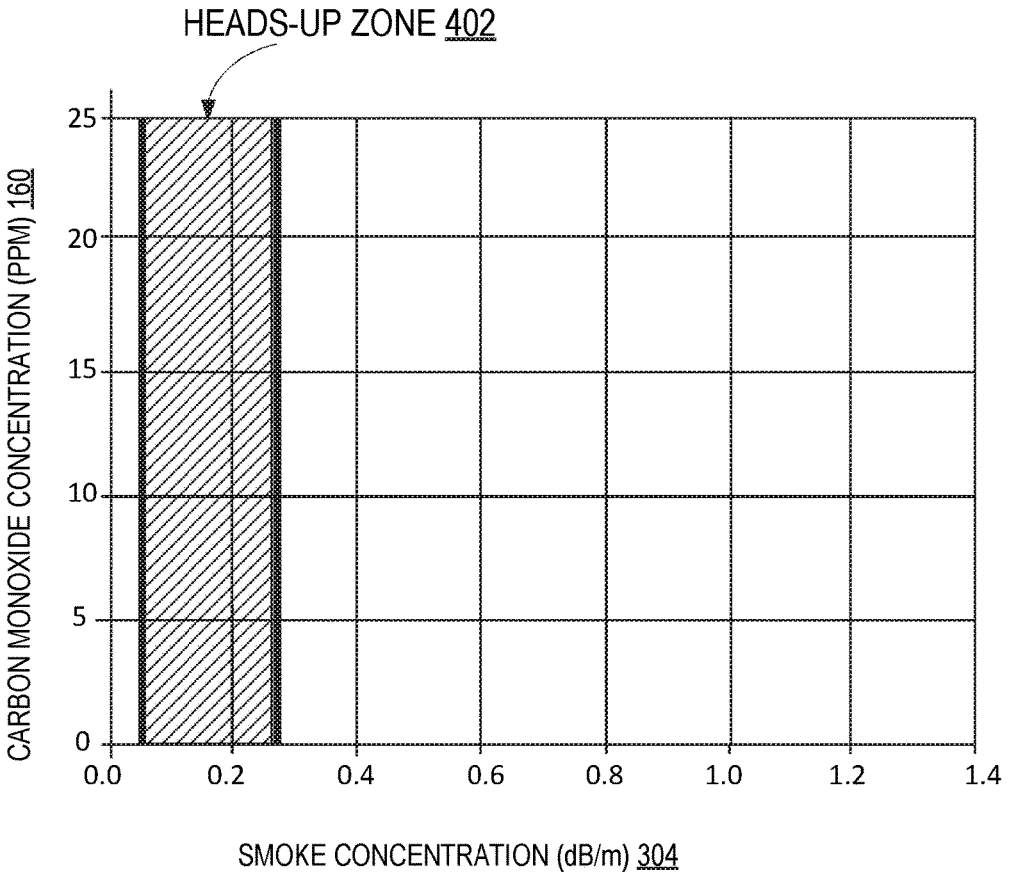
FIG. 4B is a schematic diagram illustrating a heads-up zone associated with the smoke detector of FIG. 2.

If the warning zone criteria 290A is not met, the assessor 308 may compare the smoke concentration 304 to the first heads-up zone criteria 290A. FIG. 4B schematically illustrates the heads-up zone 402, in an embodiment. An event may be categorized by the primary characterizer 312 as a heads-up event if the assessor 308 determines that the event falls in the heads-up zone 402 (i.e., meets the heads-up zone criteria 291A). In the illustrated embodiment, the heads-up zone criteria 291A may include a lower limit and an upper limit of smoke concentration 304. For example, as shown in FIG. 4B, the current smoke concentration 304 may be in the heads-up zone 402 if the smoke concentration 304 is greater than or equal to 0.15 dB/m and is less than 0.28 dB/m. If the assessor 308 determines that the smoke concentration 304 is in the heads-up zone 402, the primary characterizer 312 may categorize the event as a heads-up event, and the alarm generator 276 may generate a heads-up alert 502 in response. For example, the alarm generator 276 may generate a heads-up alert 502 where the smoke concentration 304 is 0.21 dB/m.

Figure 6:
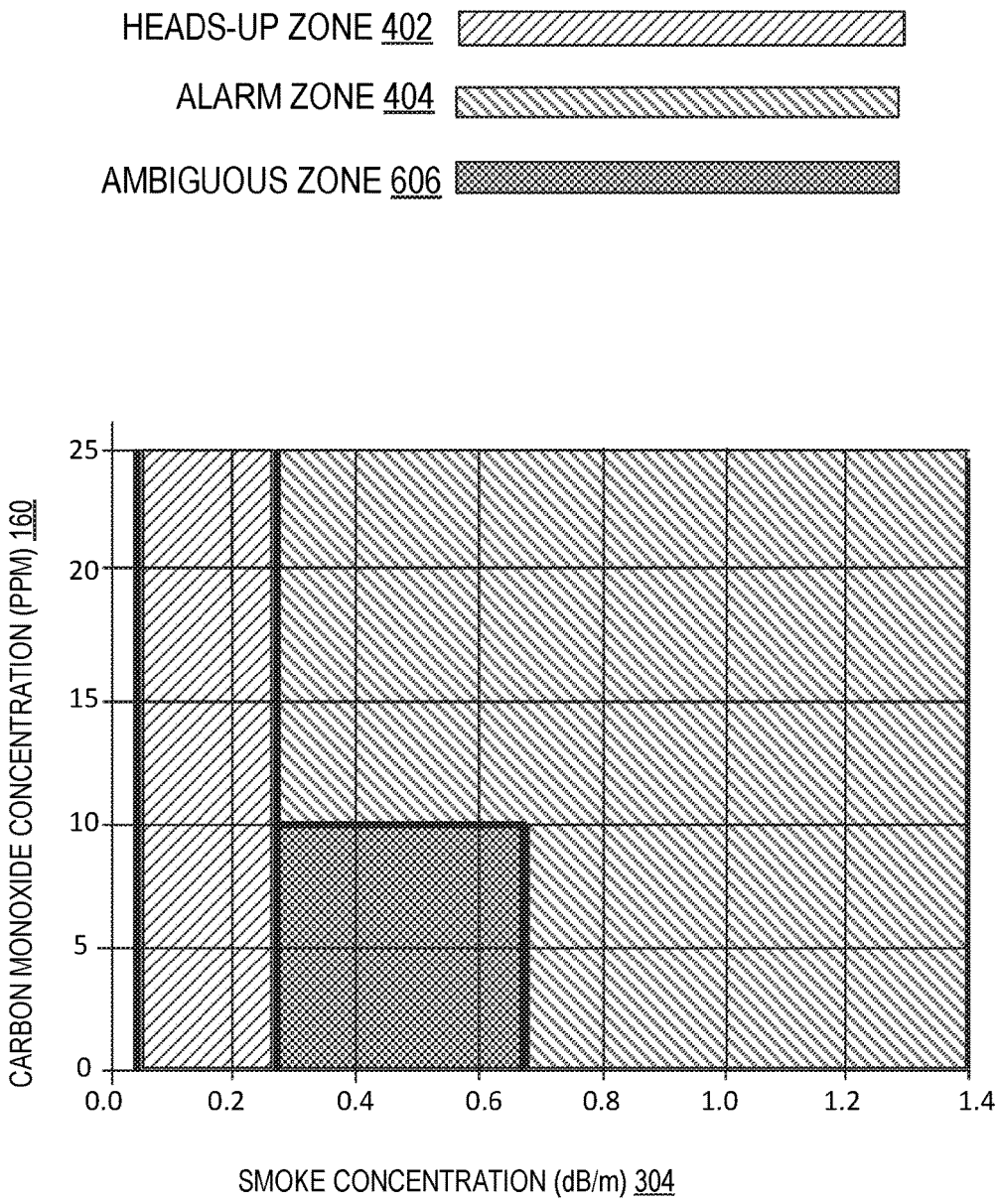
FIG. 6 is a schematic diagram illustrating an ambiguous zone associated with the smoke detector of FIG. 2.

The current smoke concentration 304 and carbon monoxide concentration 160 alone may not allow for the identification of all events as one of a heads-up event and a warning event. More specifically, events falling into an ambiguous zone 606 (FIG. 6) may meet neither the warning zone criteria 290A nor the heads-up zone criteria 291A. If the primary evaluator 272 is unable to characterize the event as one of a normal event, a warning event, or a heads-up event, the event may be characterized by the primary characterizer 312 as an ambiguous event. The event monitor 240 may then call the secondary evaluator 274 to resolve the ambiguity. For example, the event monitor 240 may call the secondary evaluator 274 where the smoke concentration 304 is 0.42 dB/m and the carbon monoxide concentration 160 is 5 parts per million.

Figure 7:
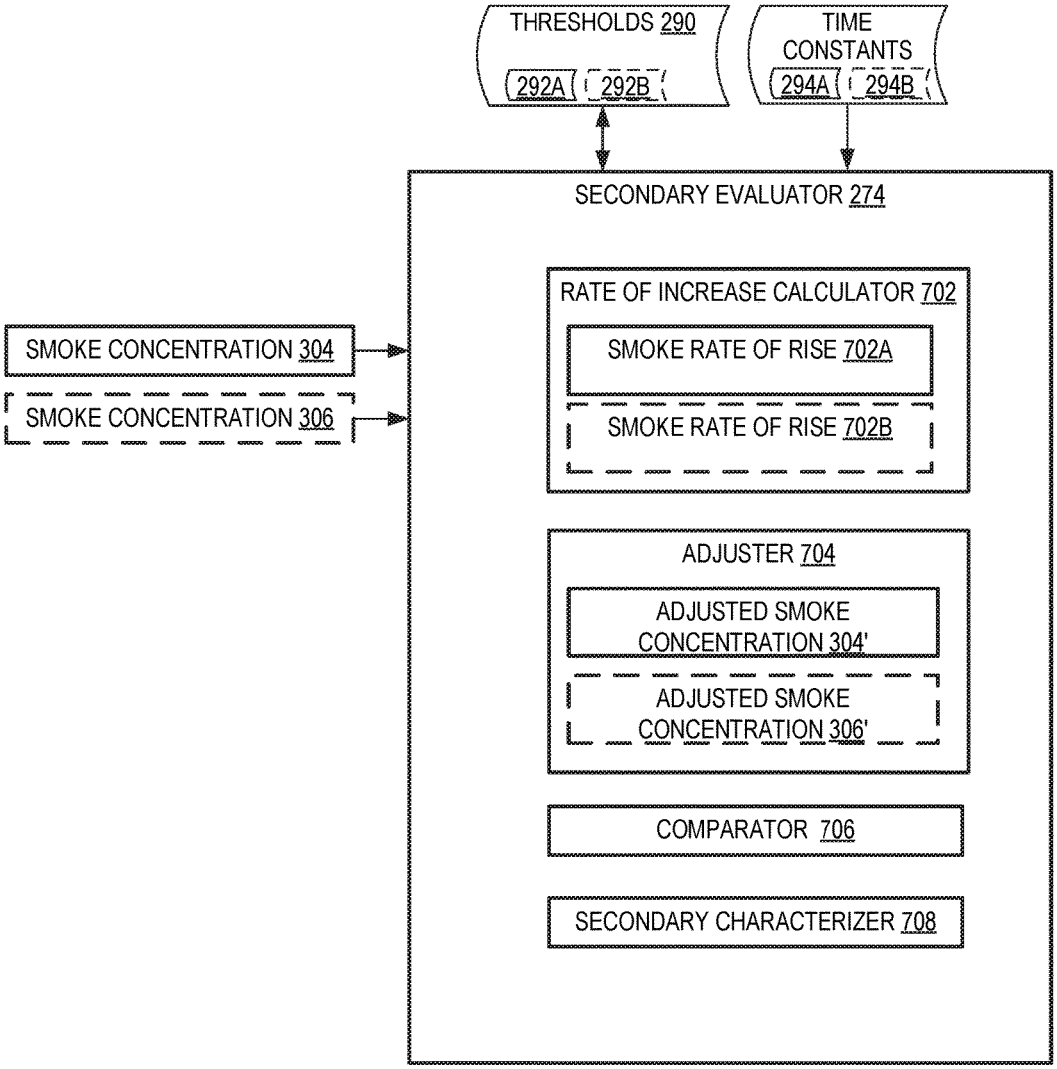
FIG. 7 is a schematic diagram illustrating a secondary evaluator of the smoke detector of FIG. 2.

The secondary evaluator 274, shown in more detail in FIG. 7, may include a rate of increase calculator 702, an adjuster 704, a comparator 706, and a secondary characterizer 708. The secondary evaluator 274 may determine a rate of increase of smoke 150 in the chamber 102 during a time period, as it has been found that the smoke concentration 304 in a warning event increases at a greater rate as compared to smoke concentration 304 in a heads-up event. For example, during a given time period (e.g., sixty seconds), smoke generated from a flaming couch may increase at a greater rate as compared to smoke generated from a broiling burger. The secondary evaluator 274 may use the rate of increase of smoke to determine whether an event falling into the ambiguous zone 606 is a warning event or a heads-up event.

In an embodiment, the rate of increase calculator 702 of the secondary evaluator 274 may initially determine the average rate of increase of smoke during a time period (e.g., during sixty seconds, or during a different length of time). For example, the smoke rate of increase calculator 702 may calculate the average smoke rate of increase 702A (dB/m/s) as follows:

$$\text{Average smoke rate of increase } 702A = [\text{Smoke concentration } 304\ (t=t_0) - \text{Smoke concentration } 304\ (t=t_0-\Delta t)]/\Delta t \quad \text{(Eq. 1)}$$

Where:

$t_0$=current sample time; and $\Delta t$=time between samples (e.g., 60 seconds or a different length of time between samples).

Once the rate of rise calculator 702 determines the average smoke rate of increase 702A during the time period (e.g., 60 seconds), the adjuster 704 may use same and the predefined first time constant 294A to determine an adjusted smoke concentration 304. In an embodiment, the adjuster 704 may determine the adjusted smoke concentration 304 (dB/m) as follows:

$$\text{Adjusted smoke concentration } 304' = \text{Smoke concentration } 304\ (t=t_0) + \text{Average smoke rate of increase } 702A * \text{time constant } 294A \quad \text{(Eq. 2)}$$

Finally, the comparator 706 may compare the adjusted smoke concentration 304' to the first threshold 292A (FIG. 2). If the adjusted smoke concentration 304' is greater than the threshold 292A, which may indicate a relatively rapid rate of increase of smoke 150 in the chamber 102, the secondary characterizer 708 may characterize the event as a warning event. Alternately, if the adjusted smoke concentration 304' is less than or equal to the first threshold 292A, which may indicate a relatively slow rate of rise of smoke 150 in the chamber 102, the secondary characterizer 708 may characterize the event as a heads-up event. The alarm generator 276 may generate a warning alarm 504 if the event is characterized by the secondary characterizer 708 as a warning event; alternately, the alarm generator 276 may generate a heads-up alert 502 if the event if categorized by the secondary characterizer 708 as a heads-up event. In this way, thus, when smoke concentration 304 and the carbon monoxide concentration 160 alone do not allow for an event to be unambiguously categorized as one of a heads-up event and a warning event, the event monitor 240 may further utilize the average rate of increase of smoke 702A to resolve the ambiguity. In essence, the alarm generator 276 of the smoke detector 200 may generate a warning alarm 504 when any of the following conditions (i)-(iii) are met:

(i) Smoke concentration 304≥0.66 dB/m;

(ii) Smoke concentration 304≥0.28 dB/m and CO concentration 160>10 ppm; or (iii) Smoke conc. 304≥0.28 dB/m and Adjusted smoke conc. 304'>first threshold 292A As discussed above, the adjusted smoke concentration 304' may be derived using the smoke concentration 304, the average smoke rate of rise 702, and the first time constant 294A. As also discussed above, in embodiments, the event monitor 240 may evaluate the event under condition (iii) only after it is determined that the event does not meet either of conditions (i) and (ii).

In an embodiment, the value of the first threshold 292A may be 0.618 dB/m, and the value of the first time constant 294A may be 671.51 seconds, as it has been found that these numerical values for the first threshold 292A and the first time constant 294A may consistently allow for an event in the ambiguous zone 606 to be correctly identified as one of a warning event and a heads-up event. Of course, in other embodiments, and depending on the configuration of the particular smoke detector, different values for the thresholds 292 and the time constants 294 may be used (e.g., may be communicated to the event monitor 240 over the interface 202). As noted above, in embodiments, the smoke alarm generator 276 may only generate a cautionary notification when an event is categorized as a warning event (i.e., the smoke detector 200 may not expressly apprise the user of a heads-up event or a normal event).

Figure 8A:
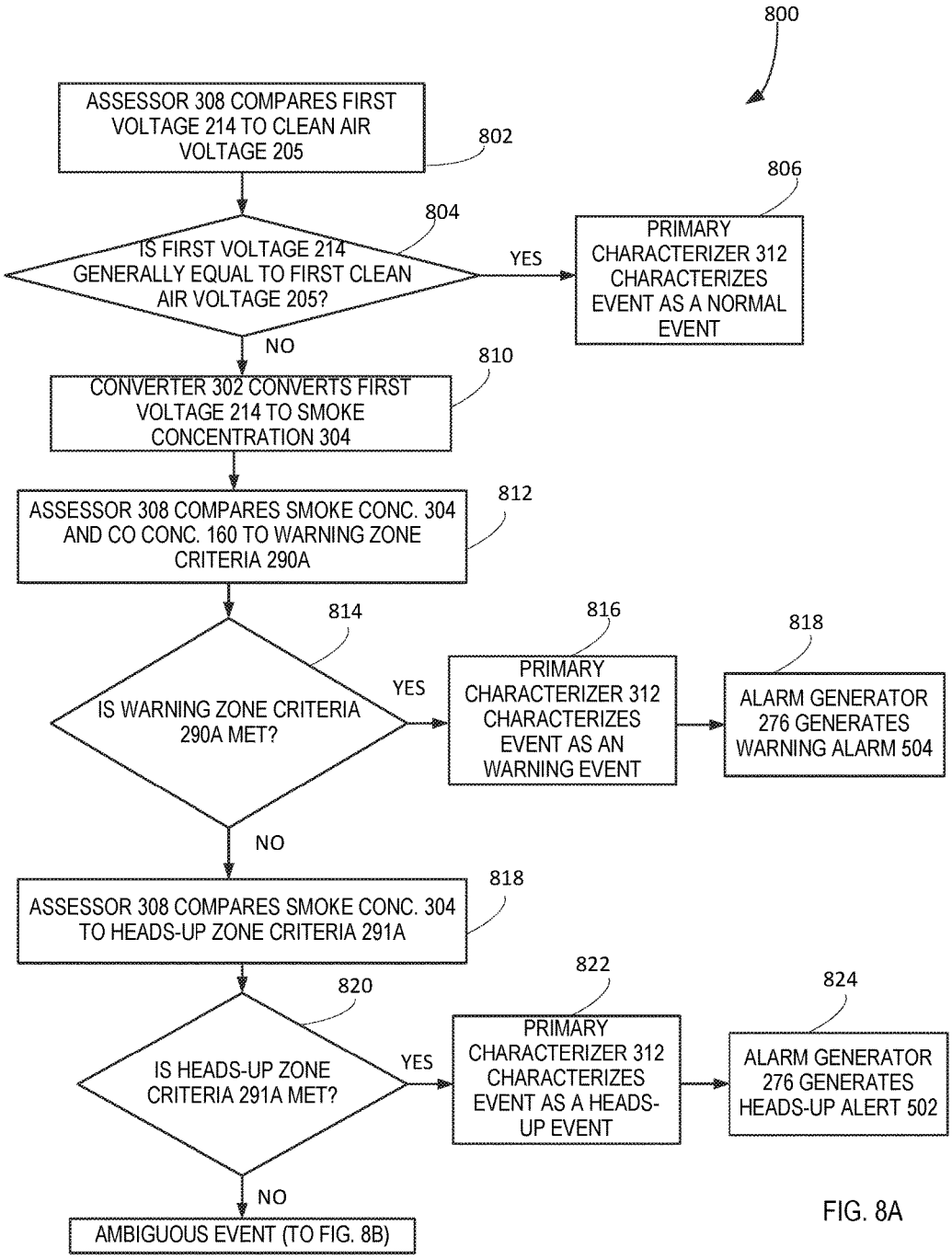
FIGS. 8A-8B are flowcharts illustrating a method of using the smoke detector of FIG. 2 to distinguish between a warning condition and a heads-up condition.
Figure 8B:
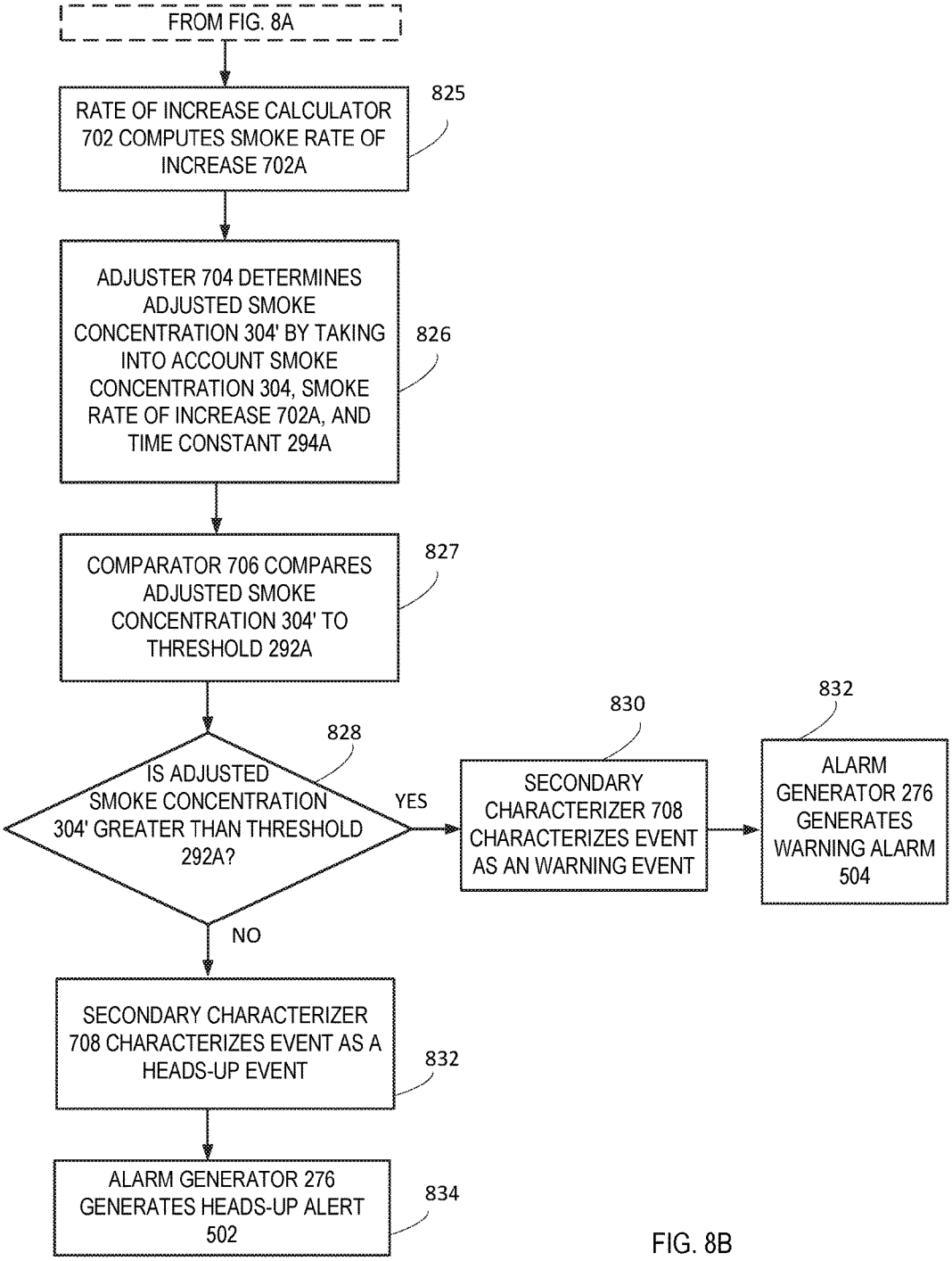

FIG. 8 illustrates a method 800 of using the smoke detector 200 to identify an event as one of a normal event, a heads-up event, and a warning event. At step 802, the primary evaluator 272, e.g., the assessor 308 thereof, may compare the first voltage 214 to the first clean air voltage 205. If the first voltage 214 is generally equal to the first clean air voltage 205 at step 804, the primary evaluator 272 may determine that the event is a normal event (e.g., the smoke detector 200 is operating under clean-air conditions). The primary characterizer 312 may therefore characterize the event as a normal event at step 806. If, on the other hand, the assessor 308 determines at step 804 that the first photodetector voltage 214 is greater than (or, in some embodiments, less than) the first clean air voltage 205, the converter 302 may, at step 810, convert the first photodetector voltage 214 to smoke concentration 304.

At step 812, the assessor 308 may compare the smoke concentration 304 and the carbon monoxide concentration 160 to the first warning zone criteria 290A. If the assessor 308 determines at step 814 that the first warning zone criteria 290A is met (e.g., the smoke concentration 304 is greater than or equal to 0.66 dB/m, or the smoke concentration 304 is greater than or equal to 0.28 dB/m and the carbon monoxide concentration 160 is greater than 10 ppm), the primary characterizer 312 may at step 816 characterize the event as a warning event. At step 818, based upon the identification of the event as a warning event, the alarm generator 276 may generate warning alarm 504.

If the assessor 308 determines at step 814 that the first warning zone criteria 290A is not met, the assessor 308 may at step 818 compare the smoke concentration 304 to the first heads-up zone criteria 291A. If the assessor 308 determines that the heads-up zone criteria 291A is met (e.g., the smoke concentration 304 is greater than or equal to 0.15 dB/m and is less than 0.28 dB/m), the primary characterizer 312 may characterize the event as a heads-up event at step 822. At step 824, based upon the identification of the event as a heads-up event, the alarm generator 276 may generate heads-up alert 502.

If, on the other hand, the assessor 308 determines at step 820 that the first heads-up zone criteria 291A is not met, the event may be initially categorized as an ambiguous event, and the event monitor 240 may call the secondary evaluator 274 to resolve the ambiguity.

At step 825, the rate of increase calculator 702 of the secondary evaluator 274 may determine the average smoke rate of increase 702A during a predefined time period. For example, as discussed above, the rate of increase calculator 702 may determine the average smoke rate of rise 702A during a given time period using equation 1.

At step 826, the adjuster 704 may determine the adjusted smoke concentration 304'. For example, the adjuster 704 may determine the adjusted smoke concentration 304' employing equation 2 above by using the current smoke concentration 304, the average smoke rate of increase 702A computed previously, and the predefined first time constant 294A.

At step 827, the comparator 706 may compare the adjusted smoke concentration 304' to the first threshold 292A. If the adjusted smoke concentration 304' is greater than the first threshold 292A at step 828, the secondary characterizer 830 may characterize the event as a warning event. At step 832, based upon the identification of the event as a warning event, the alarm generator 276 may generate warning alarm 504. Alternately, if at step 828 the adjusted smoke concentration 304' is less than or equal to the first threshold 292A, the secondary characterizer 830 may characterize the event as a heads-up event at step 832. The alarm generator 276 may, based upon the identification of the event as a heads-up event, generate the heads-up alert 502 at step 834. In this way, thus, when smoke concentration 304 and the carbon monoxide concentration 160 alone do not allow for an event to be unambiguously categorized as one of a heads-up event and a warning event, the event monitor 240 may further utilize the rate of increase of smoke 702A to resolve the ambiguity.

Figure 9:
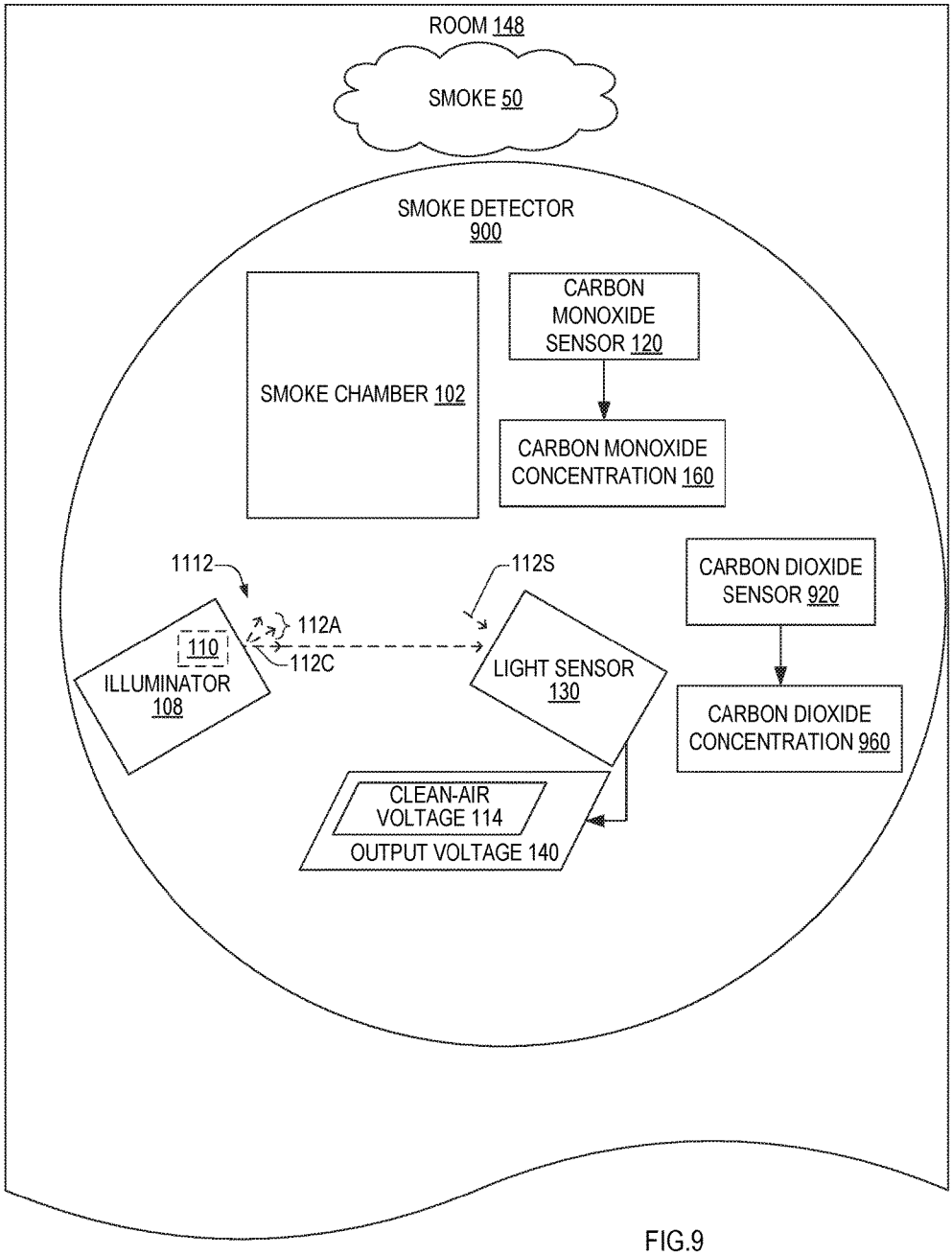
FIG. 9 is a schematic diagram of a smoke detector, in another embodiment.

FIG. 9 shows a smoke detector 900, according to an example embodiment. The smoke detector 900 may be generally identical to the smoke detector 100, except as specifically noted and/or shown, or as would be inherent. Those skilled in the art will appreciate that the smoke detector 100 (and thus the smoke detector 900) may be modified in various ways, such as through incorporating all or part of any of the various described embodiments, for example. For uniformity and brevity, corresponding reference numbers may be used to indicate corresponding parts, though with any noted deviations.

A primary hardware difference between the smoke detector 100 and the smoke detector 900 may be that, unlike the smoke detector 100, the smoke detector 900 includes a carbon dioxide sensor 920 that determines carbon dioxide concentration 960. As discussed above, smoke concentration 304 and carbon monoxide concentration 160 alone may not allow for the proper characterization of an event that falls in the ambiguous zone 606, and the smoke detectors 100 and 200 may employ the smoke rate of increase calculator 702 to resolve the ambiguity. The smoke detector 900 may not employ the smoke rate of increase calculator 702. Rather, where an event falls within the ambiguous zone 606, the smoke detector 900 may employ the rate of rise of carbon dioxide (ppm/sec) to determine whether the event is a warning event. It has been found that akin to smoke 150, which increases more rapidly in a warning event as compared to a heads-up event, the carbon dioxide concentration 960 also increases more rapidly in a warning event as compared to a heads-up event.

Figure 12:
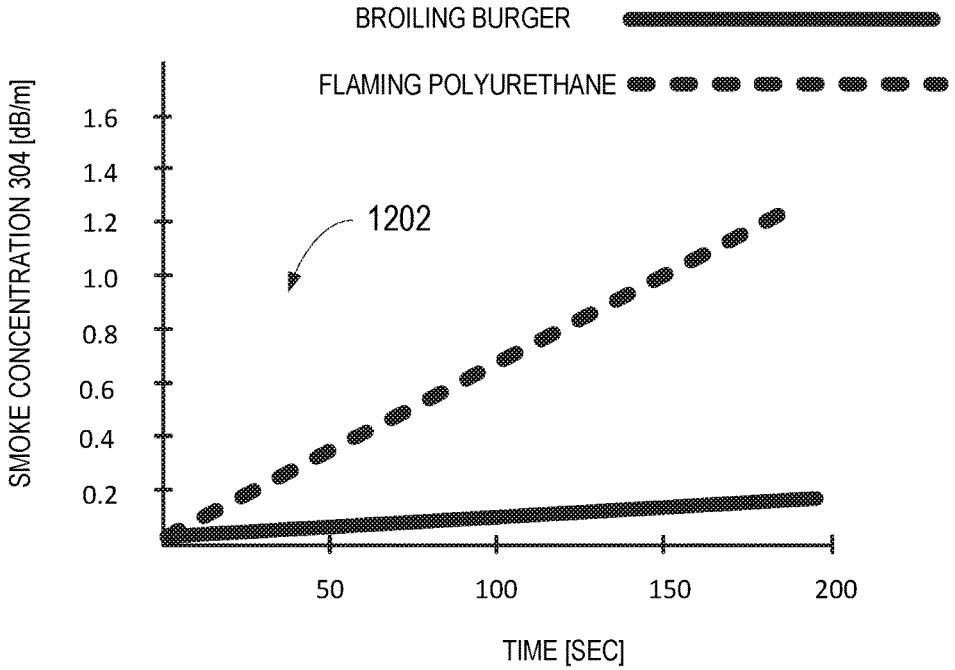
FIG. 12 is a schematic diagram illustrating the rate of increase of smoke and carbon dioxide in a heads-up event and an alarm event.
Figure 12:
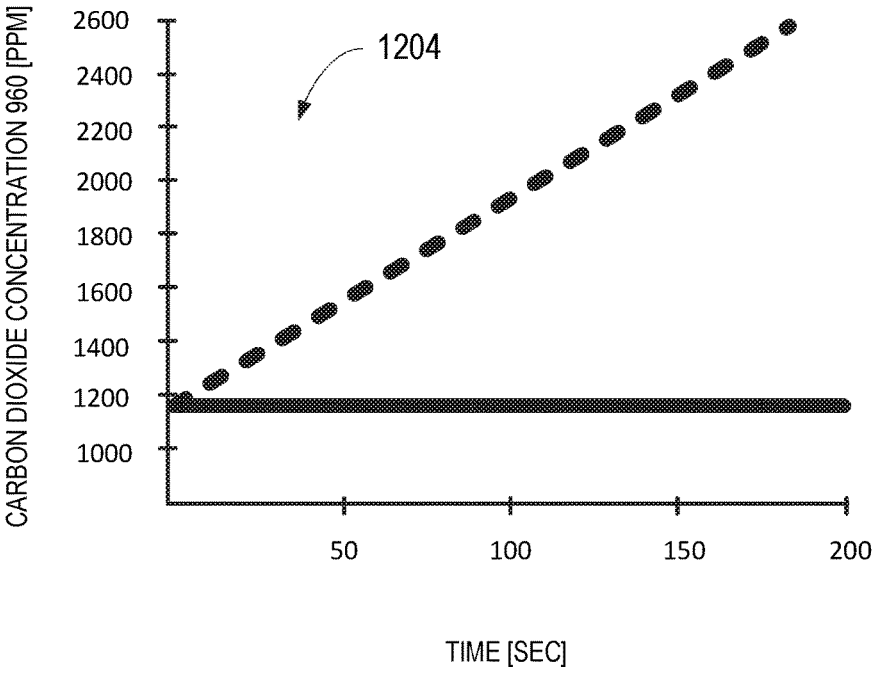

FIG. 12 illustrates the rate of rise of smoke and the rate of rise of carbon dioxide in each of a heads-up event and a warning event. Specifically, plot 1202 shows the smoke concentration 304 changing over time for each of a heads-up event (i.e., a broiling burger in this example) and a warning event (i.e., flaming polyurethane in this example). As can be seen in plot 1202, each of a broiling burger event and a flaming polyurethane event result in a net increase in the smoke concentration 304 over a given time period; however, the concentration of smoke associated with the warning event increases at a faster rate as compared to the concentration of smoke associated with the heads-up event.

Plot 1204 illustrates the change in carbon dioxide concentration 960 over time for the events illustrated in plot 1202. As is clear, the rate of increase of carbon dioxide is greater for the warning event as compared to the heads-up event. The smoke detector 900 may use this trait to distinguish a heads-up event from a warning event.

Figure 10:
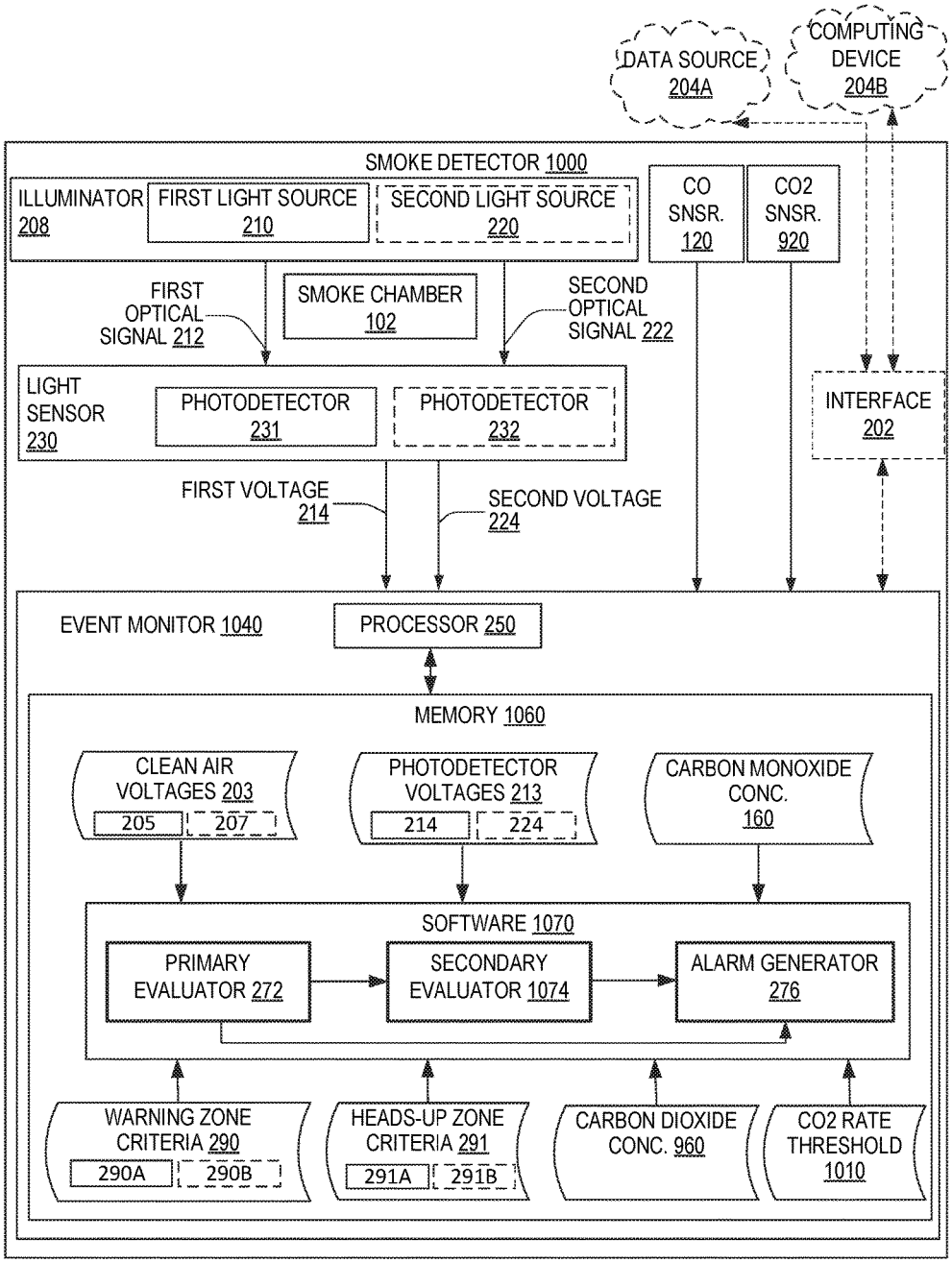
FIG. 10 is a schematic diagram of a smoke detector, which is a more detailed example of the smoke detector of FIG. 9.

FIG. 10 is a schematic diagram of a smoke detector 1000, which is an example of smoke detector 900. The event monitor 1040 thereof has memory 1060 which, like memory 260, stores clean air voltage(s) 203, photodetector voltage(s) 213, carbon monoxide concentration 160, warning zone criteria 290, and heads-up zone criteria 291. The memory 1060 may further store the carbon dioxide concentration 960 and carbon dioxide rate threshold 1010.

The event monitor 1040 may have the primary evaluator 272, which may use the smoke concentration 304 and/or the carbon monoxide concentration 160 to determine if an event is one of a normal event, a heads-up event, and a warning event, as discussed above for smoke detector 200. Where the event falls in the ambiguous zone 606, secondary evaluator 1074 may evaluate the rate of increase of carbon dioxide concentration 960 over a given length of time to determine if the rate of increase of carbon dioxide (in ppm/sec) exceeds the carbon dioxide rate threshold 1010.

Figure 11:
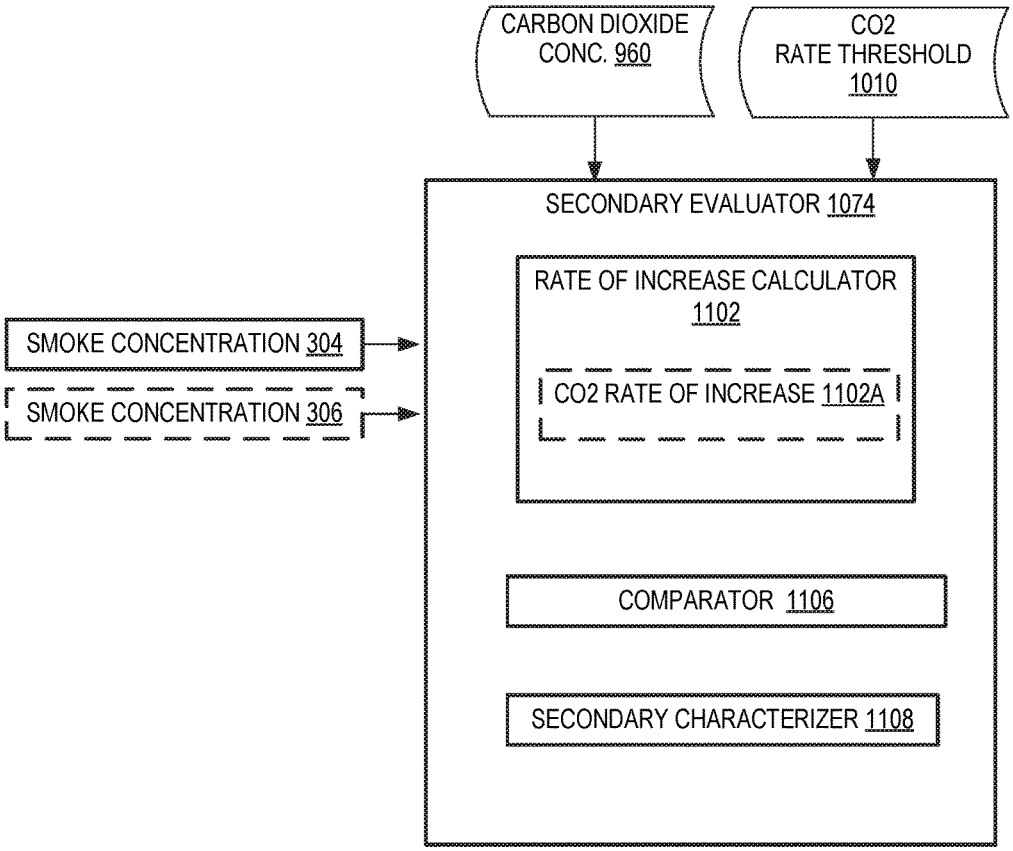
FIG. 11 is a schematic diagram illustrating a secondary evaluator of the smoke detector of FIG. 10.

FIG. 11 shows the secondary evaluator 1074 in additional detail. The secondary evaluator 1074 may have a rate of increase calculator 1102, which may calculate the rate of increase of carbon dioxide 1102A in the chamber 102 over a given time period (e.g., over one second, five seconds, ten seconds, or a different time period). The comparator 1106 may then compare the carbon dioxide rate of increase 1102A with the carbon dioxide rate threshold 1010. If the carbon dioxide rate of increase 1102A is greater than or equal to the carbon dioxide rate threshold 1010, the secondary characterizer 1108 may characterize the event as a warning event, and the alarm generator 276 may generate a warning alarm 504 in response. Alternately, if the rate of increase of carbon dioxide 1102A is below the carbon dioxide rate threshold 1010, the secondary characterizer 1108 may characterize the event as a heads-up event, and the alarm generator 276 may, in embodiments, generate a heads-up alert 502 in response. As discussed above for smoke detector 200, in embodiments, the smoke detector 1000 may identify a warning event, but the identification of the heads-up event may be omitted; in these embodiments, a cautionary notification may be generated by the event monitor 1040 only upon the identification of a warning event. In essence, the smoke detector 1000 may generate a warning alarm when any of the following conditions (iv)-(vi) are met:

(iv) Smoke concentration 304≥0.66 dB/m;

(v) Smoke concentration 304≥0.28 dB/m and CO concentration 160>10 ppm; or (vi) Smoke conc. 304≥0.28 dB/m and $CO_2$ rate of increase 1102A>$CO_2$ rate threshold 1010.

It will be appreciated that conditions (iv) and (v) are the same as condition (i) and (ii), respectively, discussed above for the smoke detector 200. In embodiments, the event monitor 1040 may evaluate the event under condition (vi) only after it is determined that the event does not meet either of conditions (iv) and (v). It is envisioned that in some embodiments, to reduce false positives, the smoke rate of rise and the carbon dioxide rate of increase will be evaluated in the smoke detector in parallel.

In an embodiment, the numerical value for the $CO_2$ rate threshold 1010 may be about 11 ppm/sec. In some embodiments, to reduce false positives, condition (vi) may be considered met only where each of a plurality of consecutive readings (e.g., five consecutive readings) of the $CO_2$ sensor 920 indicate that the $CO_2$ rate of increase 1102A is greater than or equal to the carbon dioxide rate threshold 1010.

Thus, as has been described, the smoke detectors 200 and 1000 may respectively evaluate the rate of increase of smoke and the rate of rise of carbon dioxide to consistently identify a warning event. Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A method for operating a smoke detector, said smoke detector comprising an illuminator and a light sensor, said method comprising:

measuring a voltage signal in response to an electromagnetic signal emitted by said illuminator;

determining a smoke concentration using said voltage signal;

calculating a rate of increase of smoke;

computing an adjusted smoke concentration by adding said smoke concentration to a product of said rate of increase of smoke and a time constant;

comparing said adjusted smoke concentration to a threshold; and generating a warning alarm in response to a finding that said adjusted smoke concentration exceeds said threshold.

2. The method of claim 1, further comprising the step of calculating said rate of increase of smoke in response to a determination that a warning zone criteria is unmet.

3. The method of claim 2, further comprising the step of calculating said rate of increase of smoke in response to a determination that a heads-up zone criteria is unmet.

4. The method of claim 1, further comprising the step of communicating with a mobile device in response to an identification of a heads-up condition.

5. The method of claim 4, further comprising the step of generating a heads-up alert in response to said identification of said heads-up condition.

6. The method of claim 5, further comprising the step of using said mobile device to interrupt said heads-up alert.

7. The method of claim 1, wherein said smoke detector includes a carbon monoxide sensor and a carbon dioxide sensor.

8. The method of claim 7, further comprising the step of calculating a rate of increase of carbon dioxide.

9. The method of claim 8, further comprising the step of calculating said rate of increase of carbon dioxide in response to a determination that each of a warning zone criteria and a heads-up zone criteria is unmet.

10. A smoke detector, comprising:

an illuminator configured to emit an electromagnetic signal;

a light sensor configured to generate a voltage signal in response to said electromagnetic signal;

a carbon monoxide sensor;

a memory storing computer-readable instructions; and a processor configured to execute said instructions to:

determine a smoke concentration;

calculate a rate of increase of smoke based upon a determination that said smoke concentration is in an ambiguous zone;

compute an adjusted smoke concentration by adding said smoke concentration to a product of said rate of increase of smoke and a time constant; and generate an alarm based on a comparison of said adjusted smoke concentration to a threshold.

11. The smoke detector of claim 10, wherein said illuminator includes a first light source and a second light source.

12. The smoke detector of claim 11, further comprising a primary evaluator and a secondary evaluator; said primary evaluator being configured to compare said smoke concentration to each of a warning zone criteria and a heads-up zone criteria.

13. The smoke detector of claim 10, further comprising a wireless network interface to communicate an alert to a mobile device.

14. The smoke detector of claim 10, further comprising a carbon dioxide sensor.

15. A method for operating a smoke detector, said smoke detector comprising an illuminator, a light sensor, and a carbon monoxide sensor, said method comprising:

measuring a voltage signal in response to an electromagnetic signal emitted by said illuminator;

determining a smoke concentration using said voltage signal;

determining a carbon monoxide concentration using said carbon monoxide sensor;

comparing said smoke concentration and said carbon monoxide concentration to a warning zone criteria;

computing an adjusted smoke concentration by using each of said smoke concentration, said rate of increase of smoke, and a time constant; and generating an alarm in response to a determination of a warning condition.

16. The method of claim 15, further comprising the step of calculating a rate of increase of carbon dioxide.

17. The method of claim 16, further comprising the step of calculating said rate of increase of carbon dioxide in response to a determination that a heads-up zone criteria is unmet.

18. The method of claim 15, further comprising the step of comparing said rate of increase of smoke to a threshold.

19. The method of claim 15, further comprising the step of generating a heads-up alert in response to a determination of a heads-up condition.

20. The method of claim 19, further comprising the step of operably coupling said smoke detector to a remote data source and a mobile device.

* * * * *